US009662252B1

(12) United States Patent
Pearson

(10) Patent No.: US 9,662,252 B1
(45) Date of Patent: May 30, 2017

(54) STAND ASSIST APPARATUS

(71) Applicant: Donald Pearson, Novi, MI (US)

(72) Inventor: Donald Pearson, Novi, MI (US)

( * ) Notice: Subject to any disclaimer, the term of this patent is extended or adjusted under 35 U.S.C. 154(b) by 0 days.

(21) Appl. No.: 15/336,913

(22) Filed: Oct. 28, 2016

(51) Int. Cl.

| | |
|---|---|
| ***A61G 5/14*** | (2006.01) |
| ***A47K 17/02*** | (2006.01) |
| ***A47C 7/62*** | (2006.01) |
| *A61G 7/053* | (2006.01) |
| *A61G 7/10* | (2006.01) |

(52) U.S. Cl.
CPC ..... *A61G 5/14* (2013.01); *A47C 7/62* (2013.01); *A47K 17/02* (2013.01); *A47K 17/026* (2013.01); *A61G 7/1038* (2013.01); *A61G 7/053* (2013.01); *A61G 7/1007* (2013.01)

(58) Field of Classification Search
CPC ..... A61G 5/14; A61G 7/1038; A61G 7/053; A61G 7/1007; A41K 17/02; A41K 17/026; A41K 2017/006; A47C 7/62; A61H 3/00
USPC ..... 135/67
See application file for complete search history.

(56) References Cited

U.S. PATENT DOCUMENTS

| | | | | | |
|---|---|---|---|---|---|
| 2,607,926 | A | | 8/1952 | De Puy | |
| 2,798,916 | A | | 6/1954 | Womble | |
| 2,734,554 | A | * | 2/1956 | Gable et al. | A61H 3/00 135/67 |
| 2,773,542 | A | | 12/1956 | Chasin | |
| 2,866,495 | A | * | 12/1958 | Diehl | A61G 5/08 135/67 |
| 3,011,179 | A | | 12/1961 | Hussey | |
| 3,840,034 | A | * | 10/1974 | Smith | A61H 3/00 135/67 |
| 4,629,162 | A | * | 12/1986 | Porche | A61G 5/14 254/93 HP |
| 4,700,730 | A | * | 10/1987 | Samuelson | A61H 3/04 135/67 |
| 4,995,412 | A | | 2/1991 | Hirn et al. | |
| 5,263,506 | A | * | 11/1993 | Narramore | A61H 3/00 135/67 |
| 5,347,666 | A | | 9/1994 | Kippes | |

(Continued)

FOREIGN PATENT DOCUMENTS

| | | | | | |
|---|---|---|---|---|---|
| JP | 11047038 | A | * | 2/1999 | A47K 17/026 |
| JP | 11113801 | A | * | 4/1999 | A58K 17/026 |
| JP | 11113802 | A | * | 4/1999 | A47K 17/026 |

*Primary Examiner* — Robert Canfield
(74) *Attorney, Agent, or Firm* — The Weintraub Group, P.L.C.

(57) ABSTRACT

The present invention provides a stand assist apparatus that can be positioned over an armless seat or toilet to assist the user in standing up and/or being seated. The stand assist apparatus includes a first and second frame, each frame having a front leg and a back leg, a support bar interconnecting the front leg and the back leg and a handle portion disposed directly above the front leg, an upper adjustable member and a lower adjustable member for adjusting the distance between the first and second frames, means for pivoting the upper and lower adjustable members about the first and second frames, and means for locking the upper and lower adjustable members between the first and second frames. The stand assist apparatus is foldable by releasing the means for locking and allowing the frames to fold together vertically as the adjustable members simultaneously pivot therebetween.

10 Claims, 3 Drawing Sheets

(56) References Cited

U.S. PATENT DOCUMENTS

| | | | | |
|---|---|---|---|---|
| 5,397,169 | A * | 3/1995 | Willans | A61G 5/14 297/411.23 |
| 5,449,013 | A * | 9/1995 | Landers | A61G 7/1038 135/67 |
| 5,605,169 | A * | 2/1997 | Light | A61H 3/04 135/66 |
| 5,950,258 | A | 9/1999 | Deyne et al. | |
| 6,035,462 | A * | 3/2000 | Bennett | A61G 7/1007 4/254 |
| 6,170,501 | B1 | 1/2001 | Cook et al. | |
| 6,338,354 | B1 | 1/2002 | Alexander | |
| 7,373,942 | B1 | 5/2008 | Yeager | |
| 2011/0232665 | A1 | 9/2011 | Barnet, Jr. | |
| 2015/0224004 | A1 | 8/2015 | Miller | |

* cited by examiner

STAND ASSIST APPARATUS

BACKGROUND OF THE INVENTION

1. Field of the Invention

The present invention pertains to a stand assist apparatus. More particularly, the present invention concerns a stand assist apparatus for facilitating the standing up from a seated position or, alternatively, sitting down from a standing position. Even more particularly, the present invention concerns a stand assist apparatus positionable around an armless seat, such as a toilet or chair.

2. Description of Related Art

While the act of standing up and/or sitting down may not be difficult for most, elderly people or other non-fully ambulatory people, such as those recovering from an injury or surgery find standing and sitting to be a painful task. The danger of standing and sitting down for these people may result in either falling or incurring further injury from excess strain on their back and/or legs, thereby delaying recovery or further aggravating an existing injury.

Those experiencing difficulty in standing or sitting find it even more problematic where the seat fails to include armrests to support oneself. These seats commonly include smaller chairs, stools, toilets, and the like. Without the use of armrests, the person has nothing to support his or her weight on and must rely exclusively on leg strength.

The related art has addressed this situation by proposing a number of solutions including standard walkers and other devices that can be situated around an armless seat. While walkers are not specifically designed to assist one in standing up or being seated, they, therefore, cannot be properly adjusted based on the size of the chair with which the walker is being used with or the size of the person using the walker.

For example, U.S. Pat. No. 6,338,354 to Alexander teaches an orthopedic walker having a rear crossbar interconnecting a pair of side frames. This is the standard construction of most walkers. This construction, having only a single crossbar, allows one to extend his or her legs between the side frames while walking. Although each of the side frames in Alexander has an adjustable height, the length of the crossbar is not adjustable and, therefore, the width of the walker cannot be adjusted for those requiring a smaller or larger width based on the size of the chair or the user.

Other walkers, or similarly structured devices are shown in U.S. Pat. Nos. 2,607,926, 2,773,542, 2,796,916, 3,011,179, 5,347,666, 5,950,258, and 6,170,501.

Each of the above devices are directed toward either assisting one in standing up from a seated position or, once in a standing position, walking about with ease. Nonetheless, the devices fail to include an adjustable crossbar providing the ability to adjust the width based on the size of the seat and/or the person using the device. Because of this deficiency, a user attempting to stand or sit is forced to position his or her hands either further apart from or closer to one another at a distance that may not be ideal for his or her specific body type. Additionally, because the width is not adjustable, these devices are limited to only being used on seats that fit between the side frames and no wider.

While the related art does disclose stand assist devices providing an adjustable width, as shown in U.S. Pat. Nos. 4,995,412 and 7,373,942, and U.S. Patent Publication Nos. 2011/0232665 and 2015/0224004, these devices are severely limited in the manner in which they fold, if at all.

For example, U.S. Pat. No. 4,995,412 and U.S. Patent Publication No. 2015/0224004 fail to teach a device that folds at all. Due to their widths being adjustable and having varying dimensions, the devices only fold once completely dismantled.

Similarly, U.S. Pat. No. 7,373,942 and U.S. Patent Publication No. 2011/0232665 each teach a device having an adjustable width that does not prevent the device from folding. While each of the devices taught therein includes at least one lockable crossbar interconnecting a pair of side frames on one side of the device, in order to fold the devices, the side frames are rotated inwardly toward the crossbar to provide a trifold and create a substantially flattened device. The downfall in these devices is that, despite the side frames being locked in place with the at least one crossbar prior to folding, pressure applied to the side frames while standing up or being seated may cause inadvertent rotation since there is no crossbar at the opposite end of the side frames.

Therefore, while each of the devices disclosed in the above references are suitable for the uses and problems they intend to solve, there is an ongoing need for improvements in a stand assist apparatus, such as one that includes an adjustable width to be situated around various sized seats and provides sufficient support without limiting the ability of the device to be folded.

It is to this to which the present invention is directed.

The above references are identified herein in recognition of a duty of disclosure of known related subject matter, which may be relevant under 37 CFR 1.56, and specifically incorporated, herein by reference as regards to the conventional approaches and constructions taught therein.

SUMMARY OF THE INVENTION

The present invention provides a stand assist apparatus comprising: (a) a first frame and a second frame, the first and second frames each including: (i) a front leg and a back leg; (ii) a support bar having a first end and a second end, the support bar interconnecting the front leg and the back leg, the support bar including a handle portion connected to the first end of the support bar and extending opposite the second end of the support bar, the handle portion being disposed directly above the front leg; (b) an upper adjustable member and a lower adjustable member for adjusting the distance between the first and second frames, the upper adjustable member interconnecting the back legs and the lower adjustable member interconnecting the front legs, the upper and lower adjustable members each being coupled to the frames at opposing ends of each of the adjustable members; (c) means for pivoting disposed at each end of the upper and lower adjustable members; (d) means for locking disposed at at least one end of each of the upper and lower adjustable members; and wherein the stand assist apparatus is foldable by releasing the means for locking and allowing the frames to fold together vertically as the upper and lower adjustable members simultaneously pivot about the means for pivoting.

In use, the stand assist apparatus is placed over an armless seat, such as a toilet. The user is assisted in standing up or being seated by gripping the handle portion of each frame and applying pressure to raise or lower the user, respectively.

Where the user desires the width of the stand assist apparatus to be adjusted, the adjustable members may be adjusted to either increase or decrease the distance between the frames.

When each of the adjustable members is unlocked, either the first or second frame may be repositioned and brought closer to the other frame as the adjustable members pivot therein, thus causing the frames to abut against one another in a vertical fashion.

For a better understanding of the present invention, reference is made to the accompanying drawing and detailed description. In the drawing, like reference numerals refer to like parts through the several views, in which:

DETAILED DESCRIPTION OF THE INVENTION

Figure 1:
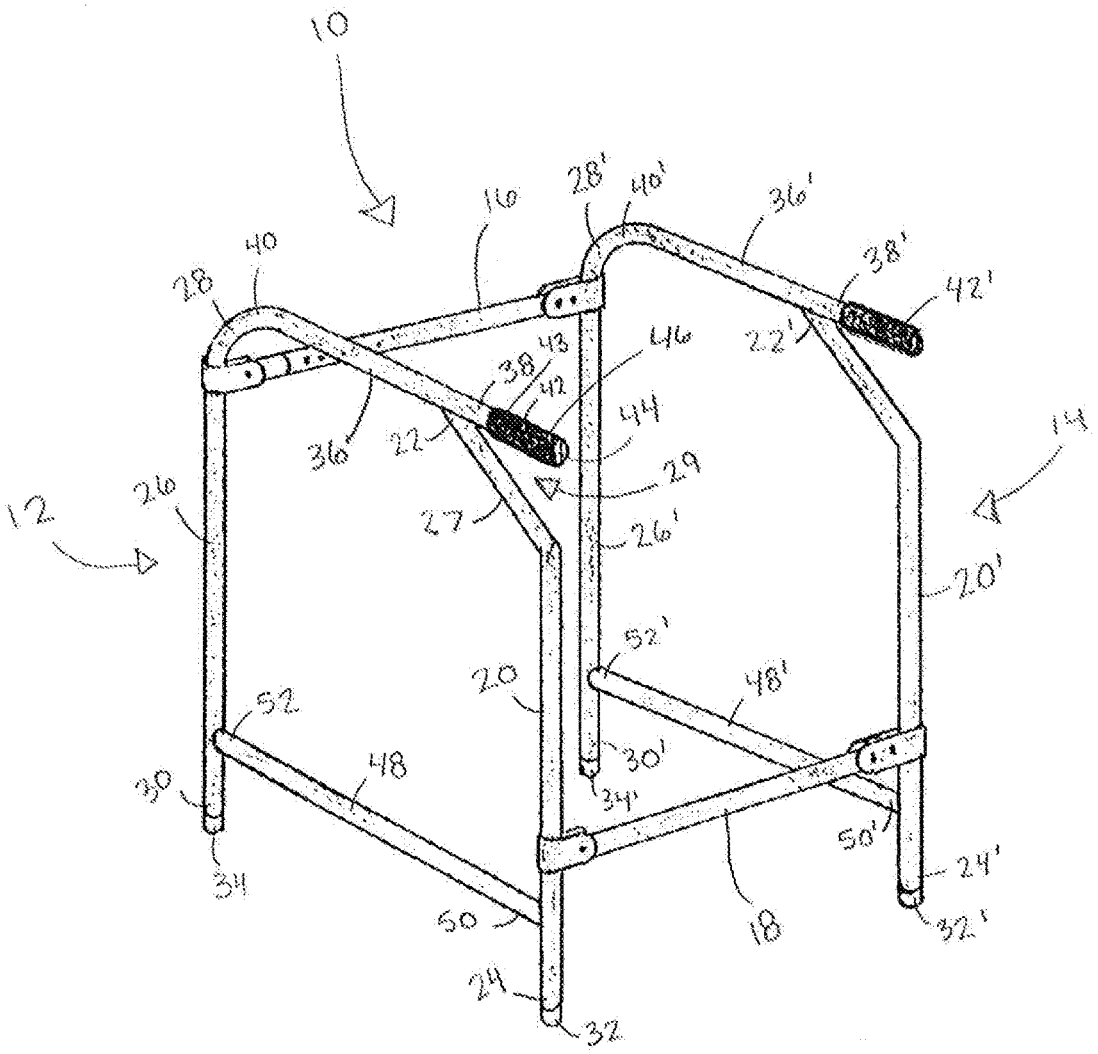
FIG. 1 is a perspective view of a stand assist apparatus in accordance with the present invention.
Figure 2:
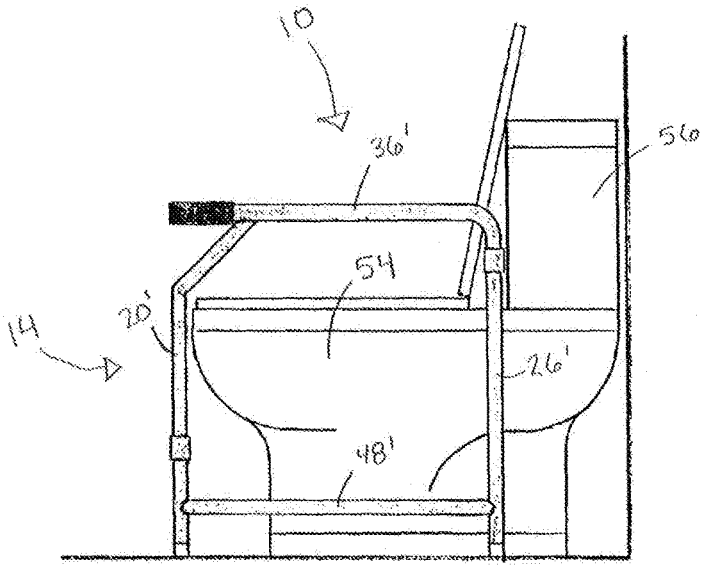
FIG. 2 is a side view of the stand assist apparatus hereof.
Figure 3:
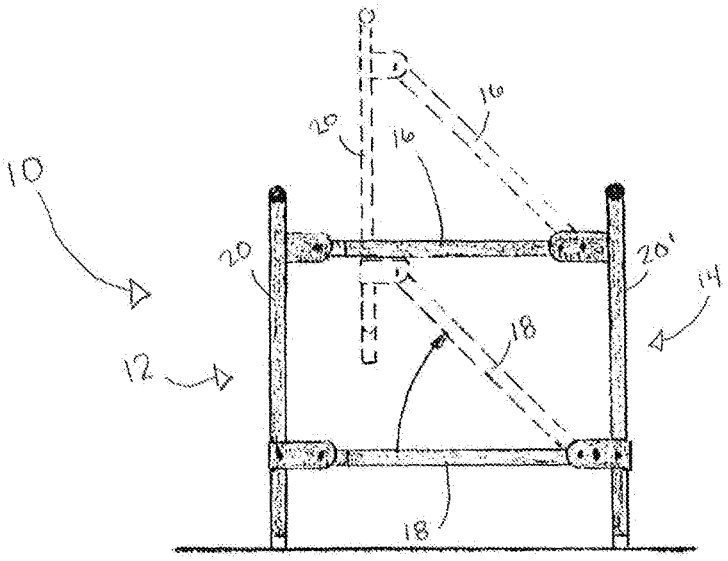
FIG. 3 is a front view of the stand assist apparatus hereof.

Now, and in accordance with the present invention and with reference to FIGS. 1-3 of the drawing, there is provided a stand assist apparatus denoted at 10, generally, comprising: (a) a first frame 12 and a second frame 14 spaced apart from one another; and (b) an upper adjustable member 16 and a lower adjustable member 18.

As shown in FIG. 1, both the first frame 12 and the second frame 14 are identical in structure. The first frame 12 includes an elongated front leg 20, having a first end 22 and a second end 24, and an elongated back leg 26, having a first end 28 and a second end 30.

The front leg 20 may be a substantially linear element or, alternatively, may include, as shown, an angular portion 27 proximate the first end 22 of the front leg 20, which extends toward the back leg 26. The angular portion 27 provides a clearance 29 for one to position his or her hand during use in front of the angular portion 27, as noted below.

A pair of stoppers 32, 34 are disposed on the second ends 24, 30 of the front and back legs 20, 26, respectively. The stoppers 32, 34 are preferably formed from rubber or other suitable friction material in order to provide optimal traction when the stand assist apparatus 10 is in use.

An elongated support bar 36, having a first end 38 and a second end 40, interconnects the front and back legs 20, 26. The support bar 36 further includes a handle portion 42 extending laterally and outwardly from the first end 38 of the support bar 36 opposite the second end 40 of the support bar 36. The handle portion 42, having an exterior surface 43, is preferably an extension 44 of the first end 38 of the support bar 36 and comprise a cushion material 46 wrapped around the exterior surface thereof. The handle portion 42 is disposed directly above and substantially perpendicular to the front leg 20 in order to ensure optimal weight distribution above the stand assist device 10 when the user stands up or sits down. When either standing or sitting, the user's hand enters the clearance 29 in front of the angular portion 27 in order to quickly find and grasp the handle portion 42 without being obstructed by the front leg 20.

The first end 22 of the front leg 20 is connected to the support bar 36 proximate the first end 38 of the support bar 36 and the first end 28 of the back leg 26 is connected to the second end 40 of the support bar 36. Where desired, the back leg 26 and support bar 36 may be integrally formed to provide improved structural durability.

Preferably, an elongated stabilization bar 48, having a first end 50 and a second end 52, is employed below and parallel to the support bar 36 to provide improved stability to the stand assist apparatus 10. The stabilization bar 48 interconnects the front and back legs 20, 26 proximate the second ends 24, 30 thereof.

As noted above, the second frame 14 is identical in structure to the first frame 12. Therefore, the second frame 14, similarly, includes a front leg 20', having a first end 22' and a second end 24', and a back leg 26', having a first end 28' and a second end 30'. As described with regards to the first frame 12, a pair of stoppers 32', 34' are disposed on the second ends 24', 30' of the front and back legs 20', 28', respectively.

The second frame 14 further includes a support bar 36' having a first end 38', a second end 40', and a handle portion 42' identical in structure to the support bar 36 of the first frame 12.

Where the stabilization bar 48 is utilized on the first frame 12, an identical stabilization bar 48', having a first end 50' and a second end 52', is preferably employed on the second frame 14 as well, which interconnects the front leg 20' and the back leg 26'.

Preferably, each of the frames 12, 14 is integrally formed from any suitable material such as tubular aluminum or the like, but, alternatively, the individual components that comprise the frames 12, 14 may be separable from one another for repair or transportation purposes.

The length of the stand assist apparatus 10 is specifically defined by the length of the stabilization bars 48, 48', if used, and positioning of the support bars 36, 36' relative to the front and back legs 20, 26, 20', 26', of the first and second frames 12, 14, respectively.

As shown in FIG. 2, it is intended that the length of the stand assist apparatus 10 be sufficiently long enough to be positioned over a standard sized toilet 54. The stand assist apparatus 10 is preferably positioned in front of a water tank 56 of the toilet 54.

As noted above, the stand assist apparatus 10 includes an upper adjustable member 16 and a lower adjustable member 18 for adjusting the width of the stand assist apparatus 10 and the distance between the first and second frames 12, 14. While the upper adjustable member 16 interconnects the back legs 26, 26' proximate the first ends 28, 28', the lower adjustable member 18 interconnects the front legs 20, 20' proximate the second ends 24, 24'. As the adjustable members 16, 18 are identical in structure, the following detailed description will be made with reference to only the upper adjustable member 16.

Figure 4:
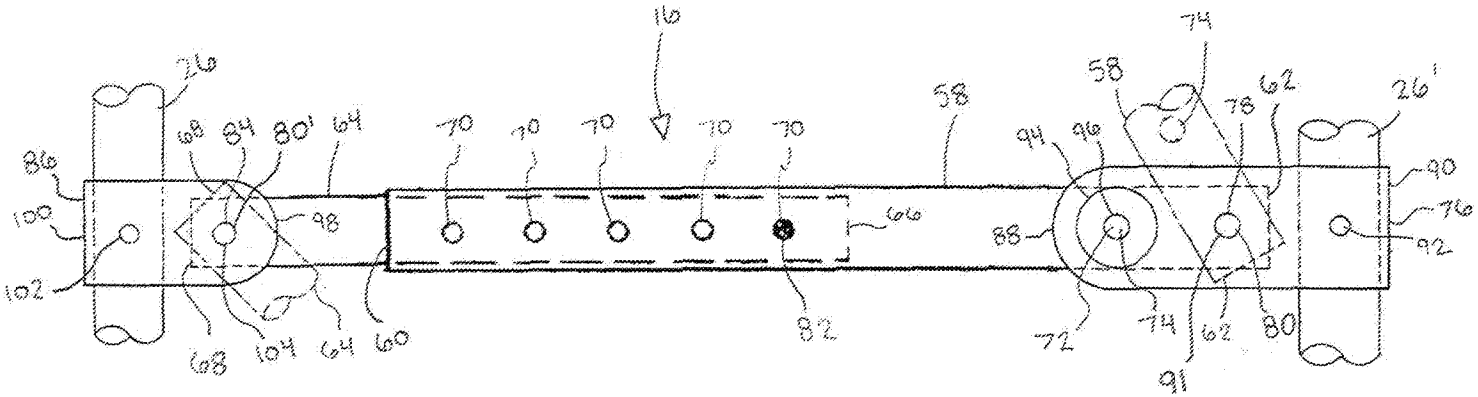
FIG. 4 is a front view of a first embodiment of an adjustable member to be used in accordance with the present invention.

As shown in FIG. 4, in a first embodiment of the upper adjustable member 16, the upper adjustable member 16, generally, comprises a hollow outer tube 58, having an open first end 60 and a second end 62, and an inner tube 64, having a first end 66 and a second end 68.

The outer tube 58 comprises a plurality of openings 70 spaced apart from one another and formed along the length of the outer tube 58. Preferably, the plurality of openings 70 are formed proximate the first end 60 of the outer tube 58. The outer tube 58 further comprises means for locking 72 provided proximate the second end 62, which locks the outer tube 58 in a substantially horizontal position. The means for locking 72 includes a spring-loaded button 74 disposed within and extending outwardly from and normal to the outer tube 58. Pressure applied to the spring-loaded button 74 causes it to compress within the outer tube 58. The spring-loaded button 74 cooperates with a first mounting bracket 76, described below, which couples the outer tube 58 to the back leg 26' of the second frame 14. Additionally, an interior pivot hole 78 is formed in the outer tube 58 proximate the second end 62 to facilitate means for pivoting 80, described below, which cooperates with the first mounting bracket 76.

Regarding the inner tube 64, the diameter of the inner tube 64 is smaller than the diameter of the outer tube 58 to allow the inner tube 64 to be slidably insertable into the open first end 60 of the outer tube 58. The inner tube 64 further comprises a spring-loaded button 82 disposed within and proximate the first end 66 of the inner tube 64. The spring-loaded button 82 protrudes outwardly from and normal to the inner tube 64, thereby being accessible from the exterior thereof. Similar to the spring-loaded button 74 in the outer tube, the spring-loaded button 82 here also compresses within the inner tube 74 when depressed. The spring-loaded button 82 is in registry with a corresponding one of the plurality of openings 70 on the outer tube 58 based on the length of the inner tube 64 that is inserted into the outer tube 58.

An interior pivot hole 84 is formed in the inner tube 64 proximate the second end 68 to facilitate means for pivoting 80', similar to means for pivoting 80, which cooperates with a second mounting bracket 86, described below.

As noted above, the first mounting bracket 76 is disposed proximate the second end 62 of the outer tube 58 for coupling the outer tube 58 to the second frame 14. The first mounting bracket 76 includes a first end 88 and a second end 90. The first mounting bracket 76 is mounted to the back leg 26' of the second frame 14 by any suitable means such as a fastener at 92. An exterior pivot hole 91, in registry with the interior pivot hole 78 in the outer tube 58, is formed in the first mounting bracket 76 to accommodate the means for pivoting 80. The means for pivoting 80 comprises any suitable pivot, such as a rivet or the like, and pivotally secures the outer tube 58 to the first mounting bracket 76. The first mounting bracket 76 further includes a recess 94 formed therein proximate the first end 88. A recess opening 96 is formed within the center of the recess 94 and is in registry with the spring-loaded button 74 when the outer tube 58 is in a substantially horizontal position. The recess 94 makes it easier for a user to access and press the spring-loaded button 74, thereby releasing the means for locking 72 and allowing the outer tube 58 to pivot about the means for pivoting 80.

The second mounting bracket 86 is disposed proximate the second end 68 of the inner tube 64 for coupling the inner tube 64 to the first frame 12. The second mounting bracket 86 includes a first end 88 and a second end 90. The second mounting bracket 86 is mounted to the back leg 26 of the first frame 12 by any suitable means such as a fastener at 102. Similar to the first mounting bracket 76, an exterior pivot hole 104, in registry with the interior pivot hole 84 in the inner tube 64, is formed in the second mounting bracket 86 to accommodate the means for pivoting 80'. The means for pivoting 80', like the means for pivoting 80, comprises any suitable pivot, such as a rivet or the like, and pivotally secures the inner tube 64 to the second mounting bracket 86.

Where desired, an additional means for locking (not shown) including a spring-loaded button and recess opening may be formed on the inner tube 64 and the second mounting bracket 86, respectively.

In use, where the stand assist apparatus 10 is in the open or unfolded position, the user initially adjusts the distance between frames 12, 14 by pressing the spring-loaded button 82 on the inner tube 64 of both the upper and lower adjustable members 16, 18 and repositioning the inner tube 64 within the outer tube 58 accordingly. The spring-loaded button 82 is then positioned within any corresponding one of the plurality of openings 70 in the outer tube 58. Once the width of the stand assist apparatus 10 is appropriately sized, it is placed over the top of an armless seat or toilet. The stand assist apparatus 10 may remain in this position to avoid repeated positioning or, alternatively, may be folded and stored when not in use.

Where the user desires to fold the stand assist apparatus 10, the user releases the means for locking 72 on each of the adjustable members 16, 18 by pressing the spring-loaded button 74 on the outer tube 58, which is accessible through the recess opening 96 of the first mounting bracket 76.

Thereafter, as shown in FIG. 3, the user is able to bring the first and second frames 12, 14 together in any suitable manner such as applying pressure to or lifting either one of the frames 12, 14 toward the other. In any event, the adjustable members 16, 18 pivot therebetween about the means for pivoting 80, 80' in the first and second mounting brackets 76, 86, respectively. This pivoting motion of the adjustable members 16, 18, illustrated by dashed lines, causes the first and second frames 12, 14 to fold and abut against one another in a vertical fashion.

Figure 5:
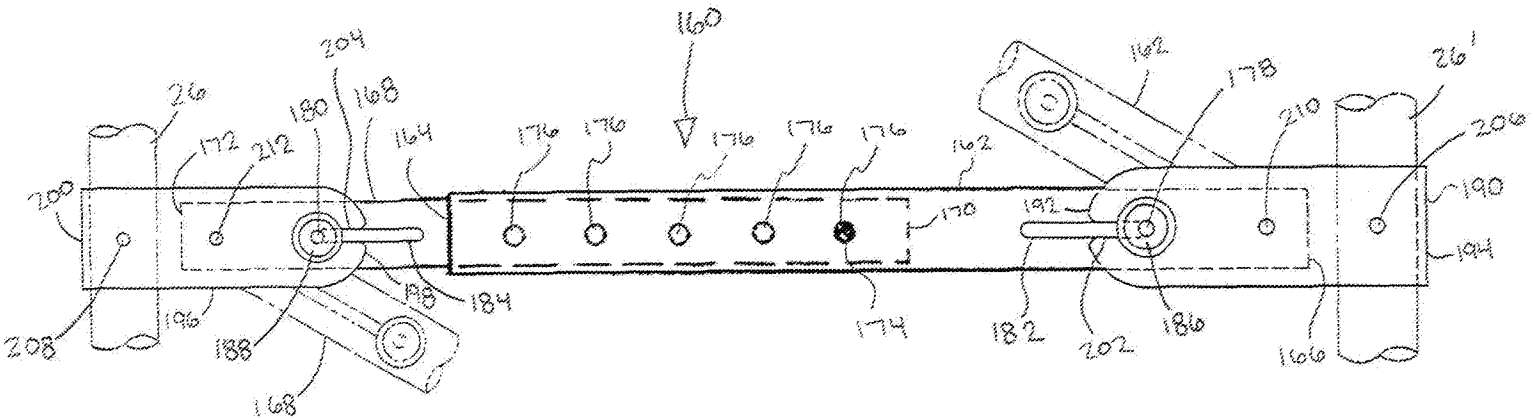
FIG. 5 is a front view of a second embodiment of an adjustable member to be used in accordance with the present invention.

Referring now to FIG. 5, there is depicted a preferred or second embodiment of an adjustable member 160 is illustrated which may be used in lieu of the upper and lower adjustable members 16, 18. Here, the adjustable member 160 is substantially identical in structure to the upper adjustable member 16, described above, including an outer tube 162, having an open first end 164 and a second end 166, and an inner tube 168, having a first end 170 and a second end 172. Similar to the upper adjustable member 16, a spring-loaded button 174 is disposed within the inner tube 168 and positionable within a plurality of openings 176 formed in the outer tube 162.

Additionally, means for locking 178 is disposed proximate the second end 166 of the outer tube 162 and, preferably, an additional means for locking 180 is disposed proximate the second end 172 of the inner tube 168. Each means for locking 178, 180 includes an elongated channel 182, 184 formed in the outer and inner tubes 162, 168, respectively, and a slidable lock 186, 188 movably disposed within each channel 182, 184.

A first mounting bracket 190, having a first end 192 and a second end 194, and a second mounting bracket 196, having a first end 198 and a second end 200, are disposed at opposing ends 166, 172 of the adjustable member 160.

The first mounting bracket 190 is secured to the back leg 26' of the second frame 14 by any suitable fastener at 206.

The second mounting bracket 196 is similarly secured to the back leg 26 of the first frame 12 by any suitable fastener at 208.

Each mounting bracket 190, 196 includes an inwardly directed cavity 202, 204 formed therein which extends from respective first ends 192, 198 of the first and second mounting brackets 190, 196. Each cavity 202, 204 is in alignment with an associated channel 182, 184 when the adjustable member 160 is in a substantially horizontal position. Thus, the slidable locks 186, 188 may be slid into and out of position within each cavity 202, 204 in order to lock or unlock the adjustable member 160 in its horizontal position.

Means for pivoting 210, 212, similar to the means for pivoting 80, 80', pivotally secure the outer and inner tubes 162, 168 to the first and second mounting brackets 190, 196, respectively. The means for pivoting 210, 212 include any suitable fastener such as a rivet or the like.

Utilizing the second embodiment of the adjustable member 160, the user folds the stand assist apparatus 10 by individually sliding each of the slidable locks 186, 188 through their respective channel 182, 184, thereby sliding out of an associated cavity 202, 204 in the first and second mounting bracket, 190, 196, respectively. Once the slidable locks 186, 188 are removed from the associated cavity 202, 204, the adjustable member 160 is free to pivot about the means for pivoting 210, 212. This pivoting motion of the adjustable member 160, illustrated by dashed lines in FIG. 3, causes the first and second frames 12, 14 to abut together vertically. When unfolded, the slidable locks 186, 188 are manually inserted back into their associated cavity 202, 204 in order to lock the adjustable member 160 in place.

Where the second embodiment of the adjustable member 160 is substituted for the first embodiment of the upper and lower adjustable members 16, 18 and means for locking 178, 180 are disposed at opposing ends 166, 172, a total of four means for locking are employed in the stand assist apparatus 10. The means for locking 178, 180 here do not require simultaneous operation and can be individually locked and unlocked. Further, including means for locking 178, 180 at each end 166, 172 of the adjustable member 160 further stabilizes the stand assist apparatus 10 and prevents unintentional folding.

From the above, it is to be appreciated that defined herein is a new and unique stand assist apparatus providing improved stability utilizing both an upper and lower adjustable member, having an adjustable length to accommodate various sized seats and toilets. The use of both upper and lower adjustable members being pivotally attached to the frames allow the assist apparatus to fold vertically.

LIST OF REFERENCE NUMERALS

10 Stand assist apparatus
12 First frame
14 Second frame
16 Upper adjustable member
18 Lower adjustable member
20 Front leg of first frame
20' Front leg of second frame
22 First end of front leg of first frame
22' First end of front leg of second frame
24 Second end of front leg of first frame
24' Second end of front leg of second frame
26 Back leg of first frame
26' Back leg of second frame
27 Angular portion of front leg
28 First end of back leg of first frame
28' First end of back leg of second frame
29 Clearance of front leg
30 Second end of back leg of first frame
30' Second end of back leg of second frame
32 Stopper
32' Stopper
34 Stopper
34' Stopper
36 Support bar of first frame
36' Support bar of second frame
38 First end of support bar of first frame
38' First end of support bar of second frame
40 Second end of support bar of first frame
40' Second end of support bar of second frame
42 Handle portion of first frame
42' Handle portion of second frame
43 Exterior surface of handle portion
44 Extension
46 Cushion material
48 Stabilization bar of first frame
48' Stabilization bar of second frame
50 First end of stabilization bar of first frame
50' First end of stabilization bar of second frame
52 Second end of stabilization bar of first frame
52' Second end of stabilization bar of second frame
54 Toilet
56 Tank of toilet
58 Outer tube
60 First end of outer tube
62 Second end of outer tube
64 Inner tube
66 First end of inner tube
68 Second end of inner tube
70 Openings in outer tube
72 Means for locking
74 Spring-loaded button of outer tube
76 First mounting bracket
78 Interior pivot hole in outer tube
80 Means for pivoting on outer tube
80' Means for pivoting on inner tube
82 Spring-loaded button of inner tube
84 Interior pivot hole in inner tube
86 Second mounting bracket
88 First end of first mounting bracket
90 Second end of first mounting bracket
91 Exterior pivot hole on first mounting bracket
92 Fastener
94 Recess in first mounting bracket
96 Recess opening
98 First end of second mounting bracket
100 Second end of second mounting bracket
102 Fastener
104 Exterior pivot hole in second mounting bracket
160 Second embodiment of upper adjustable member
162 Outer tube
164 First end of outer tube
166 Second end of outer tube
168 Inner tube
170 First end of inner tube
172 Second end of inner tube
174 Spring-loaded button of inner tube
176 Plurality of openings in outer tube
178 Means for locking
180 Means for locking
182 Channel in outer tube
184 Channel in inner tube
186 Slidable lock in outer tube
188 Slidable lock in inner tube
190 First mounting bracket
192 First end of first mounting bracket
194 Second end of first mounting bracket
196 Second mounting bracket
198 First end of second mounting bracket
200 Second end of second mounting bracket
202 Cavity of first mounting bracket
204 Cavity of second mounting bracket
206 Fastener on first mounting bracket
208 Fastener on second mounting bracket
210 Means for pivoting on first mounting bracket
212 Means for pivoting on second mounting bracket

Having thus described the invention, what is claimed is:

1. A stand assist apparatus comprising:

(a) a first frame and a second frame, the first and second frames each including:

(i) a front leg and a back leg;

(ii) a support bar having a first end and a second end, the support bar interconnecting the front leg and the back leg, the support bar including a handle portion connected to the first end of the support bar and extending opposite the second end of the support bar, the handle portion being disposed directly above the front leg;

(b) an upper adjustable member and a lower adjustable member for adjusting the distance between the first and second frames, the upper adjustable member interconnecting the back legs and the lower adjustable member interconnecting the front legs, the upper and lower adjustable members each being coupled to the frames at opposing ends of each of the adjustable members;

(c) means for pivoting disposed at each end of the upper and lower adjustable members;

(d) means for locking disposed at at least one end of each of the upper and lower adjustable members; and wherein releasing the means for locking allows the frames to fold together vertically as the upper and lower adjustable members simultaneously pivot about the means for pivoting.

2. The stand assist apparatus of claim 1 wherein the first and second frames each include a stabilization bar interconnecting the front and back legs.

3. The stand assist apparatus of claim 1 further comprising a plurality of stoppers, each one of the plurality of stoppers being disposed on respective second ends of the front and back legs.

4. The stand assist apparatus of claim 3 wherein each one of the plurality of stoppers is a rubber stopper.

5. The stand assist apparatus of claim 1 wherein the first end of the front leg is angled toward the back leg to provide a clearance below the handle portion for positioning a hand of a user.

6. The stand assist apparatus of claim 1 further comprising a cushion material wrapped around the exterior surface of the handle portion.

7. The stand assist apparatus of claim 1 wherein the upper and lower adjustable members each include an outer tube, having an open first end, a second end, and a plurality of openings formed along the length thereof, and an inner tube, having a first end, a second end, and a spring-loaded button disposed along the length thereof and extending outwardly from and normal to the inner tube, the inner tube being slidably positionable within the outer tube through the open first end, the spring-loaded button being positionable within any one of the plurality of openings formed in the outer tube to lock the inner tube within the outer tube.

8. The stand assist apparatus of claim 1 wherein the means for pivoting includes a first and second mounting bracket pivotally secured to respective ends of the upper and lower adjustable members, the first and second mounting brackets being fixedly mounted to the second frame and the first frame, respectively.

9. The stand assist apparatus of claim 8 wherein the means for locking includes:

(a) an elongated channel formed in the outer tube of each of the upper and lower adjustable members proximate the second end of the outer tube, a slidable lock disposed within the channel, the slidable lock extending outwardly from and normal to the outer tube;

(b) an elongated cavity formed in the first mounting bracket of each of the upper and lower adjustable members and in alignment with the channel of the outer tube when the outer tube is in a substantially horizontal position; and wherein the slidable lock of the outer tube is insertable and removable from the cavity in the first mounting bracket in order to lock and unlock the outer tube from the first mounting bracket.

10. The stand assist apparatus of claim 9 wherein the means for locking further comprises:

(a) an elongated channel formed in the inner tube of each of the upper and lower adjustable members proximate the second end of the inner tube, a slidable lock disposed within the channel, the slidable lock extending outwardly from and normal to the inner tube;

(b) an elongated cavity formed in the second mounting bracket of each of the upper and lower adjustable members and in alignment with the channel of the inner tube when the inner tube is in a substantially horizontal position; and wherein the slidable lock of the inner tube is insertable and removable from the cavity in the second mounting bracket in order to lock and unlock the inner tube from the second mounting bracket.

* * * * *